United States Patent [19]

Chun et al.

[11] Patent Number: 4,707,160

[45] Date of Patent: Nov. 17, 1987

[54] PARTICLES CONTAINING ACTIVE HALOGEN BLEACH IN A DILUTED CORE

[75] Inventors: Kil Whan Chun, Wyckoff; Allan H. Gilbert, Oradell, both of N.J.; David J. Lang, Ossining, N.Y.; Edward Santos, Guttenberg, N.J.

[73] Assignee: Lever Brothers Company, New York, N.Y.

[21] Appl. No.: 815,412

[22] Filed: Dec. 31, 1985

[51] Int. Cl.[4] ..... D06L 3/00; D06L 3/06; C11D 9/42; A62D 3/00

[52] U.S. Cl. ..... 8/101; 8/108.1; 8/137; 252/97; 252/99; 252/102; 252/174; 252/186.35

[58] Field of Search ..... 252/97, 99, 186.25, 252/186.34, 186.35, 174, 102, 187.2; 8/137, 101, 107, 108.1, 115.6

[56] References Cited

U.S. PATENT DOCUMENTS

| | | | |
|---|---|---|---|
| 3,112,274 | 11/1963 | Morganthaler et al. | 252/99 |
| 3,650,961 | 3/1972 | Hudson | 252/99 |
| 3,908,045 | 9/1975 | Alterman et al. | 252/103 |
| 4,136,052 | 1/1979 | Mazzola | 252/99 |

*Primary Examiner*—Josephine L. Barr
*Attorney, Agent, or Firm*—Milton L. Honig; James J. Farrell

[57] ABSTRACT

A bleach particle is provided whose core is an intimately dispersed agglomerated mixture of a halogen bleaching agent, an inorganic phosphate salt and a binder with melting point 85° to 120° F. In the preferred composition there is present dichloroisocyanurate, sodium tripolyphosphate and lauric acid, respectively. These core particles have a uniform round shape, are of high strength and obtainable in good yields.

15 Claims, No Drawings

PARTICLES CONTAINING ACTIVE HALOGEN BLEACH IN A DILUTED CORE

BACKGROUND OF THE INVENTION

1. Field of the Invention

The invention relates to active halogen containing bleach particles and a method for bleaching substrates through slow uniform release of halogenating agent.

2. The Prior Art

Particles containing oxidants for bleaching substrates have been widely disclosed in the literature. Much research has focused upon coating or encapsulating chlorinating agents, e.g. dichloroisocyanurate granules, to obtain delayed, slow release of active oxidant.

When used for cleaning clothes in automatic washing machines, several problems are noted with encapsulated oxidants. Low bleaching strength is encountered because of incomplete dissolution of the encapsulates during the standard wash cycle. Another problem is severe fabric color damage from the localization of released bleach. Generally, bleaching products are placed into the automatic washing machine simultaneously with the dry load. Bleach and fabric remain in close contact as the machine fills with water. Local high concentrations of bleaching actives thereby come into contact with fabric surfaces. Under these conditions, very small spots resembling pinholes appear on the fabric.

U.S. Pat. No. 4,136,052 (Mazzola) reports to have solved the pinhole problem caused by localized high concentrations of bleach. The patent provides a special coating which encapsulates the bleaching compound. An active chlorinating agent is surrounded by a first non-reactive coating combination of fatty acid and wax. A second coating is applied containing fatty acid with a material exhibiting inverse aqueous solubility with respect to temperature. The outer, second coating is more resistant to dissolution in hot than in cold water. By this means, sufficiently delayed bleach release is provided in hot water to prevent pinholing.

U.S. Pat. No. 3,908,045 (Alterman et al.) discloses dichloroisocyanurate salts encapsulated with a first coating of a saturated fatty acid surrounded by a second coating of soap. The latter coating is formed by treatment of portions of the inner fatty acid shell with a solution of an alkali metal hydroxide.

Organic coating materials protect the bleaching agent in the foregoing patents. A slightly different approach is reported in U.S. Pat. No. 3,112,274 (Morgenthaler et al.). Inorganic salts such as sodium tripolyphosphate are applied in a fluidized bed to coat polychloroisocyanurate salts. The resultant encapsulated salts are said to be protected from decomposition by the attack of moisture, air or other reactive materials.

The prior art coatings surrounding the chlorine bleach provide adequate protection against pinhole type fabric damage only at low and medium wash temperatures. Unfortunately, at hot wash temperatures above the melting point of the coating materials, pinholing is still a problem. It has been suggested that hot water pinholing is greatly increased by non-uniform coating. Fabric damage is caused here by the inadequately encapsulated particle fraction. To solve the problem, average coating weights have been increased by as much as 50% over the known art. Even these increased thicknesses do not ensure complete absence of pinholing at hot wash temperatures. Very thick coatings, which do control pinholing, are deficient because they nearly eliminate chlorine release at low wash temperatures.

Consequently, it is an object of the present invention to provide bleach particles which eliminate pinholing yet have satisfactory active halogen release at all wash temperatures.

A further object of this invention is to provide bleach particles of spherical shape that are readily coatable to a thickness substantially uniform for all particles.

Another object of this invention is to provide a method for bleaching various substrates including fabrics.

Another object of this invention is to establish a reliable, efficient method for production of these bleach particles.

SUMMARY OF THE INVENTION

Hard spherical bleaching particles are provided whose composition is an intimately dispersed agglomerated mixture comprising:

(i) from about 1 to 80% by weight of an oxidizing material having at least one reactive chlorine or bromine atom in its molecular structure;

(ii) from about 1 to 80% of an inorganic phosphate salt; and (iii) from about 0.5 to 60% of a binder with melting point 85° to 120° F.

DETAILED DESCRIPTION OF THE INVENTION

The present invention combines a chlorine or bromine bleaching agent, with an inorganic phosphate salt and a binder. The result is a diluted core particle. These particles are coherent, hard and spherical. They may deliver high levels of bleaching agent. During subsequent coating processes, e.g. fluid bed treatment, the particles remain coherent; they do not readily break apart.

Moreover, these particles, when agitated, are readily soluble at all common wash temperatures. The structural arrangement of the diluted core particle aids in dispersing oxidant during dissolution in water. Protective coatings of only 25–30% by weight of the total particle are found to sufficiently prevent pinhole damage during the typical 4-minute automatic washing machine fill cycle, even at high wash temperatures. Thereafter, particles dissolve rapidly during the agitation cycle. High levels of bleaching agent are therefore available through most of the wash cycle.

Inorganic phosphate salts suitable for the present invention include the alkali metal salts of tripolyphosphate, orthophosphate and pyrophosphate. Sodium tripolyphosphate is, however, particularly preferred. The inorganic phosphate salt may be present from about 1 to about 80% by weight of the core material. Preferably, the phosphate is present from about 20 to about 80%.

Among the suitable halogen donor bleaches are heterocyclic N-bromo and N-chloro imides such as trichlorocyanuric, tribromocyanuric, dibromocyanuric and dichlorocyanuric acids, and salts thereof with water-solubilizing cations such as potassium and sodium.

Other N-bromo and N-chloro imides may also be used such as N-brominated and N-chlorinated succinimide, malonimide, phthalimide and naphthalimide. Other compounds include the hydantoins, such as 1,3-dibromo and 1,3-dichloro-5,5-dimethylhydantoin, N-monochloro-C,C-dimethylhydantoin methylene-bis(N-bromo-C,C-dimethylhydantoin); 1,3-dibromo and 1,3-dichloro 5-isobutylhydantoin; 1,3-bromo and 1,3-dichloro 5-methyl-5-ethylhydantoin; 1,3-dibromo and 1,3-dichloro 5,5-isobutylhydantoin; 1,3-dibromo and 1,3-dichloro 5-methyl-5-n-amylhydantoin, and the like. Further useful hypohalite liberating agents comprise tribromomelamine and trichloromelamine.

Dry, particulate, water-soluble anhydrous inorganic salts are likewise suitable for use herein such as lithium, sodium or calcium hypochlorite and hypobromite.

The hypohalite liberating agent, may, if desired, be provided in the form of a stable solid complex or hydrate. Examples include sodium p-toluene-sulfobromoamine trihydrate, sodium benzene-sulfo-chloramine dihydrate, calcium hypobromite tetrahydrate, calcium hypochlorite tetrahydrate, etc. Brominated and chlorinated trisodium phosphate formed by the reaction of the corresponding sodium hypohalite solution with trisodium phosphate (and water if necessary) likewise comprise efficacious materials.

Sodium dichloroisocyanurate is, however, the preferred bleaching source because of its great water solubility, high chlorine content and dry storage stability when combined with the other core components. Although it could be used, calcium hypochlorite is more reactive and tends to lose chlorine activity during storage. Coarse grade sodium dichloroisocyanurate is used so that there is a high recovery of proper mesh size particles. This material is commercially available under the trademark Clearon CDB, a product of the FMC Corporation.

Bleaching agents may be employed in admixtures comprising two or more distinct chlorine donors. An example of a commercial mixed system is one available from the Monsanto Chemical Company under the trademark designation "ACL-66" (ACL signifying "available chlorine" and the numerical designation "66", indicating the parts per pound of available chlorine). The material comprises a mixture of potassium dichloroisocyanurate (4 parts) and trichloroisocyanurate acid (1 part).

By the term reactive chlorine or bromine is meant any oxidant capable of releasing halogen in the form of free elemental chlorine or bromine under conditions normally used for detergent bleaching purposes. It must also be understood that the hard spherical bleaching particles of this invention are not limited to their utility for washing fabric. They may also be used on dentures, floors and a variety of other hard or soft surfaces requiring cleaning with a controlled release oxidant.

In addition to the aforedescribed halogen containing oxidants, there are numerous other similar materials well known in the art. The list is by no means exhaustive. For instance, suitable chlorine-releasing agents are also disclosed in the ACS monogram entitled "Chlorine - Its Manufacture, Properties and Uses" by Sconce, published by Reinhold in 1962.

When utilizing the particles of this invention in a detergent formulation, the desired chlorine level in a wash solution is about 10 to about 200 parts per million available chlorine. Preferably, the range is about 15 to 50 ppm for the most efficient utilization of chlorine containing material as a brightener to be used with colored clothes. These levels determine the amount of bleach particles which must be incorporated into a detergent formulation.

Anywhere from about 1 to 90% by weight of the total particle may be halogen containing oxidizing material. Preferably from about 30 to 70%, more preferably from about 40 to 60% of oxidizing material is present.

Sodium tripolyphosphate is used as the diluent base powder in the core material. It may be present from about 1 to 80% by weight of the total core material. Preferably, it should be present from about 10 to 60%.

A third essential element is a binder with a melting point between 85° to 100° F. Lauric acid is the binder of choice. It softens at common, low wash temperatures; yet, it is still solid at room temperature. Higher chain fatty acids do not release bound chlorine at low wash temperatures. Fatty acids with lower melting points do not keep the particles firm during subsequent fluidization and encapsulation processing. Dichloroisocyanurate is also stable when in contact with lauric acid during long periods of storage.

Other binders having the requisite melting point range may be suitable such as organic esters, alcohols, polyols, ketones and amides. Typical examples include: alkali metal soaps, waxes, gums and starches.

A preferred embodiment of the bleaching particles is one comprising a combination of dichloroisocyanurate, sodium tripolyphosphate and fatty acid binder. When these components are processed at temperatures above the fatty acid melting point, the surface tension of the resultant mixture is sufficient to render the particles spherical. No reaction occurs between the aforementioned components. Combinations of dichloroisocyanurate and fatty acid with base powders other than sodium tripolyphosphate result in either poor or no core particle formation at all. Mixtures with sodium sulfate lack adequate surface tension resulting in hard pastes which must be ground in an added processing step. Sodium sulfate diluted core particles of the proper mesh size are obtained only in low yield (30–40%); they are more brittle and irregularly shaped than those incorporating sodium tripolyphosphate. Substitution of sodium carbonate for sodium tripolyphosphate results in no agglomeration at all; core material of suitable physical consistency cannot be produced with this salt.

Core material is typically prepared by combining a bleaching agent such as sodium dichloroisocyanurate with sodium tripolyphosphate and lauric acid in a rolling drum mixer. After brief mixing of components by rotation of the drum, heated air is blown through the composition until a temperature is attained slightly above the melting point of the fatty acid. Agglomeration of the tripolyphosphate and fatty acid binder around the dichloroisocyanurate granules is thereby accomplished. A combination of surface tension and action of the rotating drum causes the core components to draw together into spherical particles. These are then cooled. The particles are screened to 18–25 U.S. Mesh with about 70% recovery. Oversized agglomerates constitute the remaining 30%; these may be ground and recycled back to the mixer. Diluted core particles may be stored for subsequent encapsulation. They are completely stable under cool, dry storage conditions.

Bleach particles of the present invention may be incorporated into a detergent composition containing surfactants, soaps, builders, enzymes, filler materials and other minor functional laundering agents commonly found in such compositions.

Surfactants present in these detergent compositions may be found in an amount from about 2% to 50% by weight, preferably from 5 to 30% by weight. These surfactants may be anionic, nonionic, zwitterionic, amphoteric, cationic or mixtures thereof.

Among the anionic surfactants are water-soluble salts of alkylbenzene sulfonates, alkyl sulfates, alkyl ether sulfates, paraffin sulfonates, α-olefin sulfonates, α-sulphocarboxylates and their esters, alkyl glycerol ether sulfonates, fatty acid monoglyceride sulfates and sulfonates, alkyl phenol polyethoxy ether sulfates, 2-acyloxy-alkane-1-sulfonates and β-alkoxy alkane sulfonates.

The soaps are included within the definition of anionic surfactants. These include sodium and potassium salts of acyclic monocarboxylic acids having chain length of about 8 to about 22 carbon atoms. Particularly useful are the salts of unsubstituted fatty acids derived from natural triglycerides, such as tallow, palm oil, cottonseed oil, olive oil, lard, rapeseed oil, etc., and the so-called "high-lauric oils" generally exemplified by the tropical nut oils of the coconut oil class, including in addition to the coconut oil, palm kernel oil, babassu oil, ouricuri oil, tucum oil, cohune nut oil, and murumuru oil. Particularly useful soaps are prepared from the mixture of about 80% tallow and about 20% coconut oil.

Nonionic surfactants are water-soluble compounds produced by the condensation of ethylene oxide with a hydrophobic compound such as an alkanol, alkylphenol, polypropoxy glycol or polypropoxy ethylene diamine. Examples of nonionic surfactants are the condensation products of ethylene oxide, propylene oxide and/or butylene oxide with $C_8$–$C_{18}$ alkyl phenols, $C_8$–$C_{18}$ primary or secondary aliphatic alcohols, $C_8$–$C_{18}$ fatty acid amides. The average moles of ethylene oxide and/or propylene oxide present in the above nonionics varies from 1 to 30; mixtures of various nonionics, including mixtures of nonionics with a lower and a higher degree of alkoxylation may also be used.

Cationic surfactants include the quaternary ammonium compounds having one or two hydrophobic groups with 8–20 carbon atoms, e.g. cetyl trimethylammonium halide or methosulphate; dioctadecyl dimethylammonium halide or methosulfate; and the fatty alkyl amines.

Zwitterionic surfactants are water-soluble derivatives of aliphatic quaternary ammonium, phosphonium and sulphonium cationic compounds in which the alphatic moieties can be straight or branched, and wherein one of the aliphatic substituents contains from about 8 to 18 carbon atoms and one contains an anionic water-solubilizing group. Examples are alkyl dimethyl propanesulfonates and alkyl dimethyl ammoniohydroxypropanesulfonates wherein the alkyl group in both types contains from about 1 to 18 carbon atoms.

Conventional alkaline detergency builders, inorganic or organic, may be found in these compositions at levels from about 2 to 80%, preferably from 10 to 50% by weight. Inorganic builders include water-soluble alkali metal phosphates, polyphosphates, borates, silicates and carbonates. Organic builders include: (1) water-soluble amino polycarboxylates, e.g. sodium or potassium ethylene diamine tetraacetates, nitrilotriacetates and N-(2-hydroxy) ethyl nitrilodiacetates; (2) water-soluble salts of phytic acid; (3) water-soluble polyphosphonates such as salts of ethane-1-hydroxy-1,1-diphosphonic acid; methylene diphosphonic acid salts; ethylene diphosphonic acid salts and ethane-1,1,2-triphosphonic acids salts; (4) water-soluble salts of polycarboxylate polymers and copolymers. Certain aluminosilicates such as synthetic zeolites can also be used.

Adjunct materials commonly used in detergent compositions may be incorporated. These include soil suspending agents such as water-soluble salts of carboxymethyl cellulose, copolymers of maleic anhydride with vinyl ethers, and alkyl or hydroxyalkyl cellulose ethers. Other adjuncts include colorants, perfumes, lather boosters, anti-foam agents, optical brighteners, anti-oxidants and anti-corrosion inhibitors.

The following examples will more fully illustrate the embodiments of the invention. All parts, percentages and proportions referred to herein and in the appended claims are by weight unless otherwise indicated.

EXAMPLE 1

Core particles were found to be best prepared by a rolling drum process. This method provides strong, coherent core particles capable of withstanding a subsequent coating operation in a fluid bed. The process involves passing heated air (about 85° to 150° F.) through a rolling drum filled with a mixture of halogen bleaching agent, inorganic salt diluent and a low melting fatty acid (binder). As the fatty acid melts, it combines with the inorganic salt to intimately encase the chlorinating agent. A nearly spherical core agglomerate is thereby created. Specific details of the process are hereinafter described.

A 4-foot long, 2-foot diameter rolling drum mixer was employed for the agglomeration. The drum was fitted with 6-inch spiral baffles to promote better mixing. A small motor rotated the drum at 32.5 rpm. Core particles were formed in batch runs of 50 lb. raw material charge. Each charge consisted of 35 lbs. of coarse or fine-coarse Clearon CDB granules, 10 lbs. of sodium tripolyphosphate and 5 lbs. of Emery 651 fatty acids. These materials were thoroughly blended by rotation of the drum for 10 minutes. Hot air was then blown through the drum to heat the core mixture.

As the temperature rose to the melting point of the fatty acids, the molten fatty acid mixture with sodium tripolyphosphate formed a coating around the Clearon CDB particles. After the reactant blend had reached 110° F., it was allowed to cool with continuing drum rotation. Upon cooling, there resulted hard, coherent, nearly spherical particles. These particles were screened to obtain sizes in the range 18–25 U.S. Standard Mesh with 30–70% recovery compared to theoretical. Measured chlorine content of the core particles ranged from 42 to 48%.

EXAMPLE 2

Various binders outside the critical melting point range of 85° to 120° F. were evaluated. Table I profiles three fatty acid binders. These are Emersol 150, Emersol 132 and Emery 651 having melting points of 147°–149°, 130°–132° and 106°–109° F., respectively. Emersol and Emery are trademarks of the Emery chemical Company, a division of National Distillers Corporation.

TABLE I

Composition and Melting Point of Fatty Acid Binders

| | Weight Percent of Fatty Acid in Formulation | | |
|---|---|---|---|
| | Emersol 150 | Emersol 132 | Emery 651 |
| Saturated Acid Components | | | |

TABLE I-continued

| Composition and Melting Point of Fatty Acid Binders | Weight Percent of Fatty Acid in Formulation | | |
|---|---|---|---|
| | Emersol 150 | Emersol 132 | Emery 651 |
| Capric $C_{10}$ | 0 | 0 | 1.0 |
| Lauric $C_{12}$ | 0 | 0 | 96.0 |
| Myristic $C_{14}$ | 3.0 | 2.5 | 3.0 |
| Pentadecanoic $C_{15}$ | 0 | 0.5 | 0 |
| Palmitic $C_{16}$ | 13.0 | 50.0 | 0 |
| Margaric $C_{17}$ | 0.5 | 1.5 | 0 |
| Stearic $C_{18}$ | 83.5 | 45.5 | 0 |
| Unsaturated Acid Components | | | |
| Oleic $C_{18:2}$ | 1.0 | 0 | 0 |
| Melting point (°F.) | 147–149 | 130–132 | 106–109 |

Table II details the chlorine release profiles of unencapsulated core particles comprising different inert diluents and Emery binders at various wash temperatures. Automatic washing machines typically have an initial water fill cycle of 4 minutes. Release of chlorinating agent within this period must be prevented or at least inhibited. Thereafter, occurs a 10–12 minute wash cycle. Within this time frame, all the chlorinating agent should be released.

Experiments 1 and 2 compare the effects of Emersol 150 relative to Emersol 132. While the higher melting point fatty acids of Emersol 150 provided good delayed release during the fill cycle, chlorine release during the wash cycle was significantly better for the lower melting point fatty acid particles. Experiment 2 demonstrates that bleach particles with Emersol 132 as binder do not provide sufficient delayed release during the fill cycle.

Experiments 3 and 4 compare the effects of Emersol 132 relative to Emery 651, the latter being a binder suitable for the present invention. Emersol 132 found bleach particles exhibit a slightly better delayed release than those of Emery 651. However, the slight advantage during the fill cycle is more than countered during the wash cycle. An abrupt change to almost 100° chlorine release occurs directly subsequent to the fill cycle with the particles described in Experiment 4. By contrast, the particles of Experiment 3 using the Emersol 132 binder failed to adequately release chlorine during the wash cycle.

TABLE II

Core Release of Chlorine Comparison With Different Binders

A. Emersol 150 vs. Emersol 132

| Experiment 1 | Experiment 2 |
|---|---|
| 10% Clearon CDB<br>80% Sodium Sulfate<br>10% Emersol 150 | 10% Clearon CDB<br>80% Sodium Sulfate<br>10% Emersol 132 |

| Wash Temperature 135° F. Time in Wash Solution (min.) | % of Available Chlorine Released in Solution | |
|---|---|---|
| | Experiment 1 | Experiment 2 |
| 4 (fill cycle) | 52.6 | 96.5 |
| 8 | 58.4 | 99.6 |
| 12 | 80.8 | 99.6 |
| 16 | 87.0 | 99.6 |

| Wash Temperature 100° F. Time in Wash Solution (min.) | % of Available Chlorine Released in Solution | |
|---|---|---|
| | Experiment 1 | Experiment 2 |
| 4 (fill cycle) | 4.3 | 46.5 |
| 8 | — | 71.5 |
| 12 | — | 84.0 |
| 16 | 63.7 | 91.7 |

TABLE II-continued

Core Release of Chlorine Comparison With Different Binders

B. Emersol 132 vs. Emery 651

| Experiment 3 | Experiment 4 |
|---|---|
| 10% Clearon CDB<br>10% Emersol 132<br>80% Sodium Tripolyphosphate | 10% Clearon CDB<br>10% Emery 651<br>80% Sodium Tripolyphosphate |

| Wash Temperature 100° F. Time in Wash Solution (min.) | % of Available Chlorine Released in Solution | |
|---|---|---|
| | Experiment 3 | Experiment 4 |
| 4 (fill cycle) | 3.9 | 21.1 |
| 8 | 19.4 | 98.4 |
| 12 | 44.1 | 98.4 |
| 16 | 71.6 | 98.4 |

EXAMPLE 3

This example illustrates the special effectiveness of inorganic phosphate salts as compared with sodium sulfate as a diluent component of the bleach core particles. A set of four particles were evaluated. Their compositions are outlined below.

| Sample | Description | Coating | Diluent | Clearon CDB | Emery 651 |
|---|---|---|---|---|---|
| 1 | Core uncoated | None | 80% sodium tripolyphosphate | 10% | 10% |
| 2 | Core uncoated | None | 80% sodium sulfate | 10% | 10% |
| 3 | Core coated | 36% Lauric/tallow soap | 80% sodium tripolyphosphate | 10% | 10% |
| 4 | Core coated | 35% Lauric/tallow soap | 80% sodium sulfate | 10% | 10% |

Samples 1 and 3 with the phosphate diluent provided core material of uniform, nearly spherical shape. Sulfate diluent containing particles of Samples 2 and 4 were irregular chunks. It was also noted that the cores of Sample 1 were easier to coat uniformly and that these particles dissolved with a more uniform dispersion of the chlorine in the wash water.

Furthermore, it was found that the hardness of the sodium tripolyphosphate containing particles resulted in less particle loss during subsequent fluidization, i.e. loss only on the order of 0.0–0.5%. Fluidization of the sulfate particles resulted in their breakup and loss of 2.0–3.5%.

The recovery of 18–25 U.S. mesh size particles from the rolling drum process where Emery 651 was the binder and sulfate the diluent was typically only 30–40%. A significant improvement was noted when phosphate was used in place of the sulfate. Yields of 18–25 U.S. mesh particles were increased to 64–84%.

Samples 1–4 were examined for particle geometry and coating thickness with an SEM apparatus. Grains of the aforementioned samples were prepared for SEM by mounting them on stubs daubed with carbon paint. The samples were then sputter-coated with gold to make them conductive. SEM measurements were then performed. Table III lists the results of this analysis. It was seen that the morphology of Sample 1 was much more uniform than that of Sample 2. The coated phosphate containing core, Sample 3, was also seen to be more uniform than that of sulfate containing Sample 4.

TABLE III

| Sample | Morphology | SEM Analyses Surface | Interior |
|---|---|---|---|
| 1 | Spheres measuring 1.5–2.0 mm in size. | Porous with needle and flake-like structures. | Agglomerated chunks; very little porosity. |
| 2 | Irregularly shaped particles measuring 1.0–1.5 mm. | Porous with chunk-like structures. | Tightly "packed" with no visible crevices. |
| 3 | Spheres measuring 2.0–2.5 mm in size. Coating thickness 0.2–0.3 mm. | Waxy coating porous. | Some of the coating has penetrated the interior filling the voids and coating the internal particles. |
| 4 | Irregular particles measuring 3.0–3.5 mm. Coating thickness 0.2–0.25 mm. | Waxy coating non-porous. Superficial crevices. | Coating, present on surface, has penetrated into particle. |

The foregoing description and examples illustrate selected embodiments of the present invention and in light thereof various modifications will be suggested to one skilled in the art, all of which are within the spirit and purview of this invention.

What is claimed is:

1. Hard spherical bleaching particles whose composition is an intimately dispersed agglomerated mixture comprising:

(i) from about 1 to about 805 by weight of an alkali metal dichloroisocyanurate;

(ii) from about 1 to about 80% of an alkali metal salt of tripolyphosphate; and (iii) from about 0.5 to about 60% of a binder with melting point 85° to 120° F.

2. Particles according to claim 1 wherein the binder is lauric acid.

3. Particles according to claim 1 wherein the binder is soap.

4. Particles according to claim 1 wherein the oxidizing material is present in an amount from about 40 to about 60%.

5. Particles according to claim 1 wherein the inorganic phosphate salt is sodium tripolyphosphate.

6. Particles according to claim 5 wherein sodium tripolyphosphate is present from about 10 to about 50%.

7. Particles according to claim 1 wherein the binder is present from about 10 to about 30%.

8. Particles according to claim 1 encapsulated by a coating.

9. Particles according to claim 8 wherein the coating is soap in an amount from about 0.5 to about 50%.

10. A detergent composition comprising from about 0.5 to about 80% of hard spherical bleaching particles according to claim 1 and from about 2 to about 50% by weight of a surfactant selected from the group consisting of anionic, nonionic, zwitterionic, amphoteric, cationic surfactants and mixtures thereof.

11. A detergent according to claim 10 further comprising from about 2 to about 80% of an organic or inorganic builder salt.

12. A method for bleaching substrates comprising applying the hard spherical bleaching particles of claim 1 suspended in an aqueous medium to said substrate.

13. A method according to claim 12 wherein the substrate is selected from the group consisting of fabrics, dentures, metals, ceramics and wood.

14. A process for preparing hard spherical bleaching particles whose composition is an intimately dispersed agglomerated mixture comprising the steps of:

(a) mixing a combination comprising:

(i) from about 1 to about 80% by weight of an alkali metal dichloroisocyanurate (ii) from about 1 to about 80% of an alkali metal salt of tripolyphosphate; and (iii) from about 0.5 to about 60% of a binder with melting point 85° to 120° F.;

(b) heating said combination during said mixing step to a temperature slightly above the melting point of said binder;

(c) cooling the resultant agglomerated particles; and (d) separating particles of U.S. mesh size 18–25.

15. A process according to claim 14 further comprising the step of spraying an aqueous soap solution onto the particles of U.S. mesh 18–25.

* * * * *